US006623252B2

(12) United States Patent
Cunningham

(10) Patent No.: US 6,623,252 B2
(45) Date of Patent: Sep. 23, 2003

(54) HYDRAULIC SUBMERSIBLE INSERT ROTARY PUMP AND DRIVE ASSEMBLY

(76) Inventor: Edmund C. Cunningham, 295 Arbour Lake Way NW., Calgary (CA), T3G 3Z8

( * ) Notice: Subject to any disclaimer, the term of this patent is extended or adjusted under 35 U.S.C. 154(b) by 0 days.

(21) Appl. No.: 09/983,459

(22) Filed: Oct. 24, 2001

(65) Prior Publication Data

US 2002/0054819 A1 May 9, 2002

(51) Int. Cl.[7] ..... F04B 17/00; F04B 35/00; E21B 43/00; E21B 19/00

(52) U.S. Cl. ..... 417/360; 417/405; 166/106; 166/378

(58) Field of Search ..... 417/360, 405, 417/53; 418/48; 166/106, 378, 330

(56) References Cited

U.S. PATENT DOCUMENTS 4,386,654 A * 6/1983 Becker ..... 166/105.5
4,928,771 A * 5/1990 Vandevier ..... 166/385
5,009,264 A * 4/1991 Sliger et al. ..... 166/106
5,474,432 A * 12/1995 Hulley et al. ..... 418/48
5,540,281 A * 7/1996 Round ..... 166/250.17
6,004,114 A * 12/1999 Cunningham et al. ..... 417/375

FOREIGN PATENT DOCUMENTS

WO WO 99/01667 * 1/1999 ..... F04C/11/00

* cited by examiner

*Primary Examiner*—Charles G. Freay
*Assistant Examiner*—Timothy P. Solak
(74) *Attorney, Agent, or Firm*—Thomas E. Malyszko

(57) ABSTRACT

A hydraulic submersible rotary pump and drive assembly is deployed and recovered through production tubing or casing using metal hydraulic tubing lines. The assembly is used in conventional oil and gas well bores, but is particularly advantageous in slant or horizontal applications for artificial fluid lift or water injection. It eliminates mechanical drive shafts running from surface, and allows rotary pumps to be changed without pulling the production tubing. The torque neutralizing drive assembly incorporates a ported connector sub to attach a submersible hydraulic drive motor to a submersible rotary production pump, a conventional pump seating nipple in the production tubing, and a seating cup assembly on the drive to seal the pump discharge from the pump suction within the tubing. Alternately, the assembly is used with a pack-off assembly to seal against a production casing or open hole when it is desirable not to use production tubing.

11 Claims, 6 Drawing Sheets

HYDRAULIC SUBMERSIBLE INSERT ROTARY PUMP AND DRIVE ASSEMBLY

FIELD OF INVENTION

The present invention relates to a hydraulic submersible rotary pump and drive assembly which can be deployed and recovered through production tubing or casing. The present assembly can be used in conventional oil and gas well bores, but is particularly advantageous in slant or horizontal oil and gas well bores for artificial fluid lift or water injection.

BACKGROUND OF INVENTION

Present submersible rotary pump drives for oil well artificial lift systems rely on deploying the pumps and drive systems on the production tubing as opposed to conventional reciprocating pumping systems which are deployed through the production tubing on a sucker rod string. Subsurface electric drives have been developed for certain rotary artificial lift systems but are not suitable for deployment through tubing because of there size and the fragile nature of the electric supply cable which would have to be used for deployment and recovery. Hydraulic submersible rotary pump drives which are just being proven for oil field artificial lift, particularly in slant and horizontal applications, are presently deployed only on production tubing for insertion into a well.

What is therefore desired is a novel hydraulic submersible rotary pump and drive assembly which can be deployed and recovered through production tubing using hydraulic metal tubing lines. In particular, the drive assembly should incorporate a ported torque neutralizing connector sub to attach a suitable hydraulic drive motor to a selected submersible rotary production pump. The pump drive should also incorporate the use of a conventional pump seating nipple in the production tubing and seating cup assembly on the drive to seal the pump discharge from the pump suction within the tubing as is common with conventional insert pumps. In an alternate version, the assembly should be capable of being used with a pack-off assembly (rather than the pump seating nipple) to seal against a production casing or open hole when it is desirable not to use production tubing.

SUMMARY OF THE PRESENT INVENTION

In one aspect the invention provides a means for oil field operators to eliminate mechanical drive shafts running from surface to a bottom hole rotary pump, which are the most problematic area of conventional pumping systems. Unlike conventional systems and other submersible drives, the present invention allows rotary pumps to be changed without pulling out the production tubing. Considerable cost savings should be realized for oil field operators by not having to pull production tubing to service a submersibly driven or conventional rotary pump.

In another aspect of this invention, it provides a ported, torque neutralizing connector sub with a motor mount end and a pump mount end having:

- left-hand threaded, or locking, connections to counteract the right-hand turn of the drive shaft;
- a hollow interior which allows for a drive shaft to be connected from a hydraulic motor to the rotor of a rotary pump;
- one or more ports in the connector sub to allow produced fluid to exit the connector sub into the production tubing or casing for passage therethrough; and,

- a means to seal the pump discharge from the pump suction within the well bore tubings.

BRIEF DESCRIPTION OF THE DRAWING FIGURES

Embodiments of the invention will now be described, by way of example only, with reference to the accompanying drawings, wherein:

FIG. 1 is a schematic view partially in vertical cross-section showing: an above ground wellhead 14; a surface hydraulic power supply unit 17; connecting hydraulic lines 15, 16; a production tubing string extending from the wellhead down a well bore to a horizontal portion thereof complete with a conventional type of pump seating nipple 13 and flow barrel; and a hydraulic submersible rotary insert pump and drive assembly 10 according to the present invention with pump seating cups and concentric steel tubing hydraulic lines extending from the top of the drive assembly internally up the length of the production tubing to the wellhead;

FIG. 1A is a view similar to FIG. 1 showing an alternate embodiment of the hydraulic submersible rotary insert pump and drive assembly 10A of the present invention which excludes the use of production tubing and utilizes a pack-off assembly 38*a* in place of a pump seating nipple and seating cups to segregate the pump suction from the pump discharge in the production casing; and, concentric steel tubing lines 15, 16 in this configuration extend from the top of the pump drive assembly up through the production casing 19 to the wellhead at surface;

Figure 2:
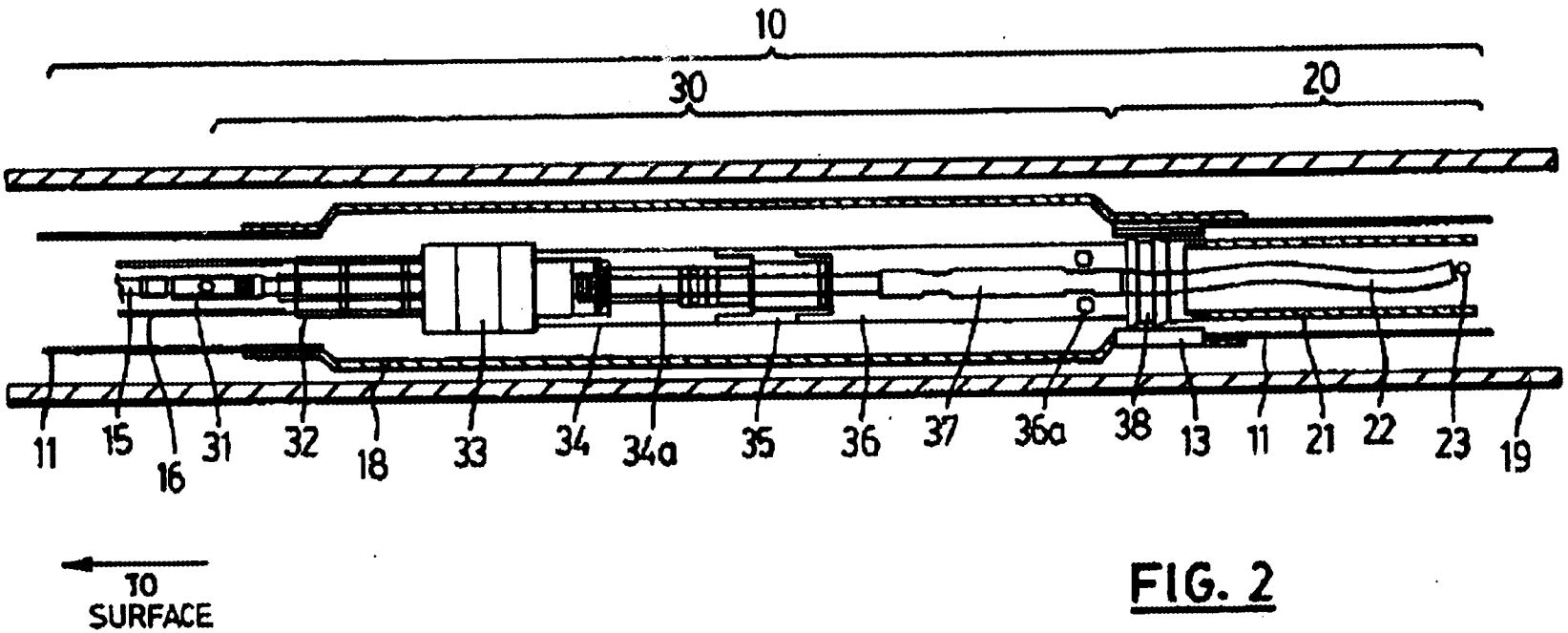
FIG. 2 is a cross sectional side view of a through tubing configuration of an insert submersible hydraulic drive and rotary pump arrangement of FIG. 1 which utilizes the pump seating nipple 13 deployed in the production tubing and a seating cup assembly on the pump drive to segregate the pump suction from the pump discharge.
Figure 2A:
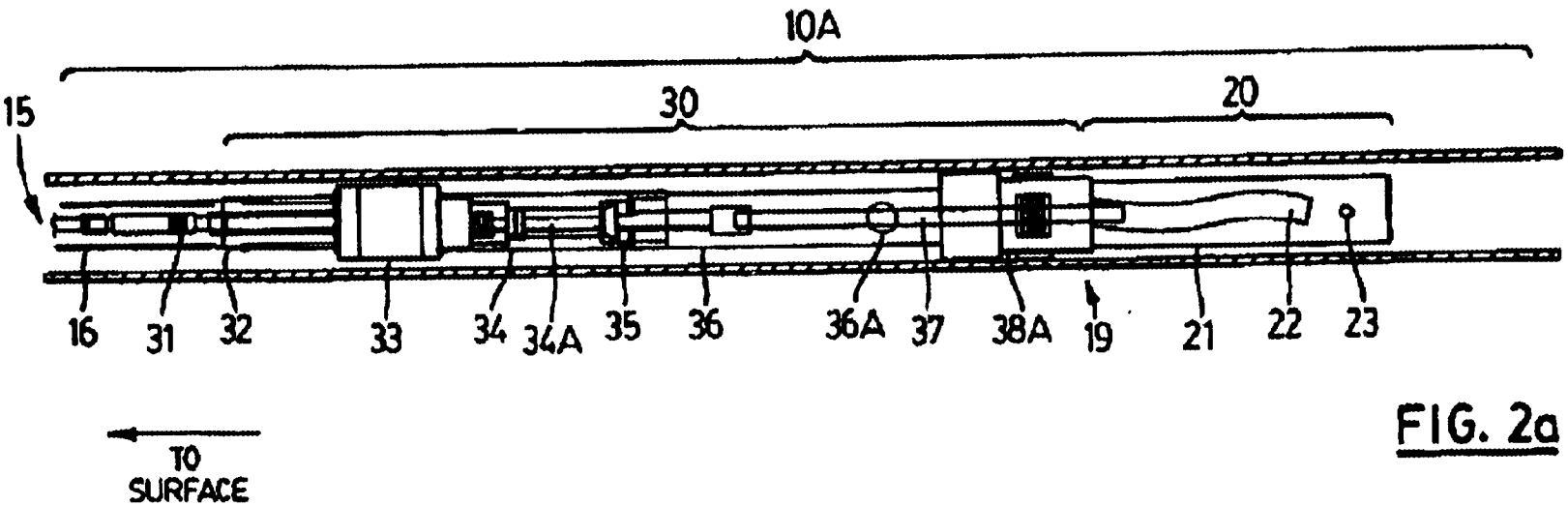
FIG. 2A is a cross sectional side view of an insert submersible hydraulic drive and pump arrangement of FIG. 1A for use without production tubing and utilizing the pack-off assembly 38*a* to segregate the pump suction from the pump discharge in the production casing or open bore hole.
Figure 3:
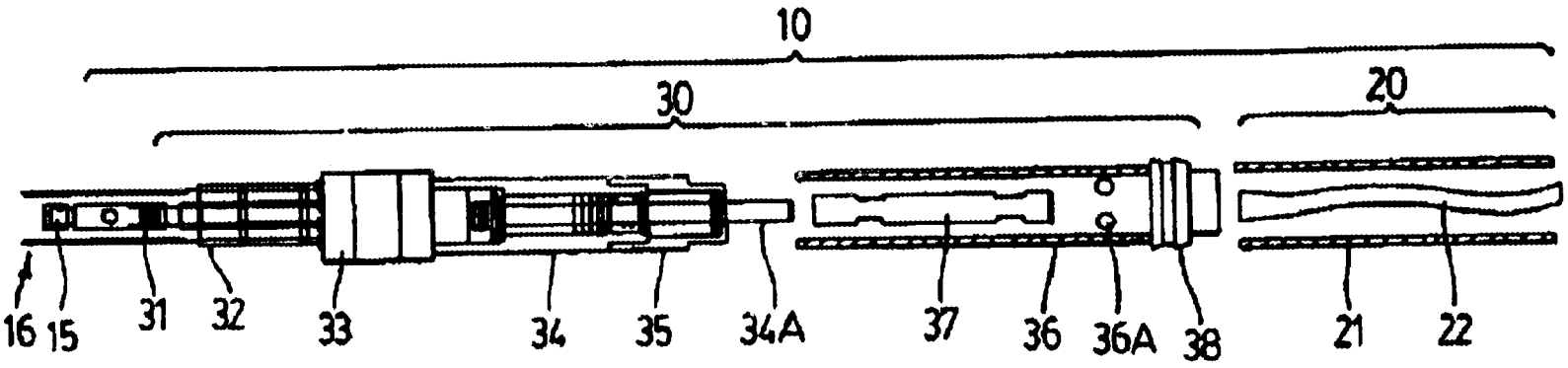
Figure 3A:
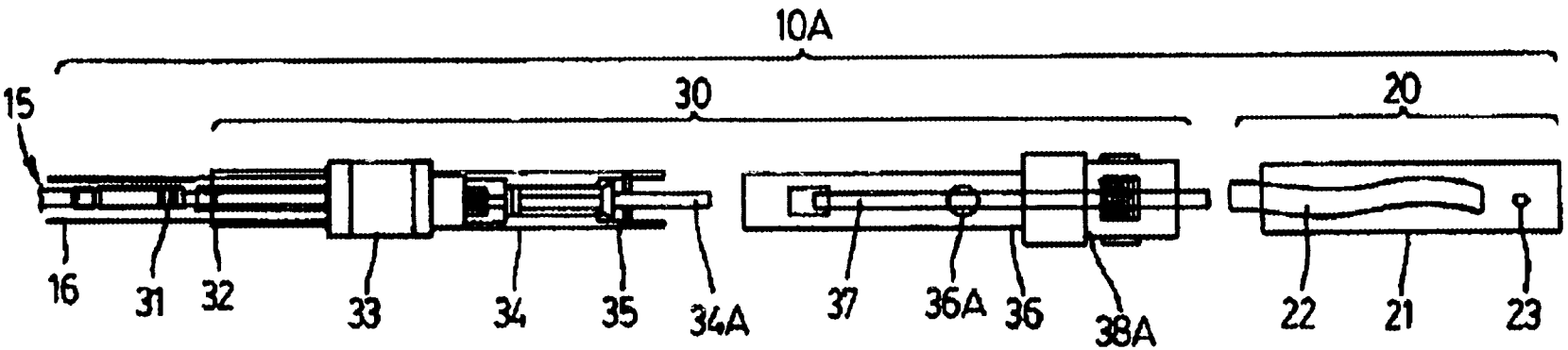

FIG. 3 is a close up cross sectional view of the FIG. 2 embodiment showing the hydraulic drive 33, ported torque neutralizing connector sub 36, drive shaft 37, and pump 20 partially decoupled; and, FIG. 3A is a close up cross sectional view of the FIG. 2A embodiment showing the hydraulic drive 33, ported torque neutralizing connector sub 36, drive shaft 37, and pump 20 partially decoupled.

LIST OF REFERENCE NUMERALS IN DRAWINGS

10 hydraulic submersible rotary pump insert arrangement with production tubing
10A hydraulic submersible rotary insert pump arrangement without production tubing
11 production tubing
12 connections of 11
13 pump seating nipple of 11
14 wellhead
15 hydraulic power fluid supply tubing
16 hydraulic power fluid return tubing
17 surface hydraulic power supply unit
18 production tubing flow barrel

Figure 1:
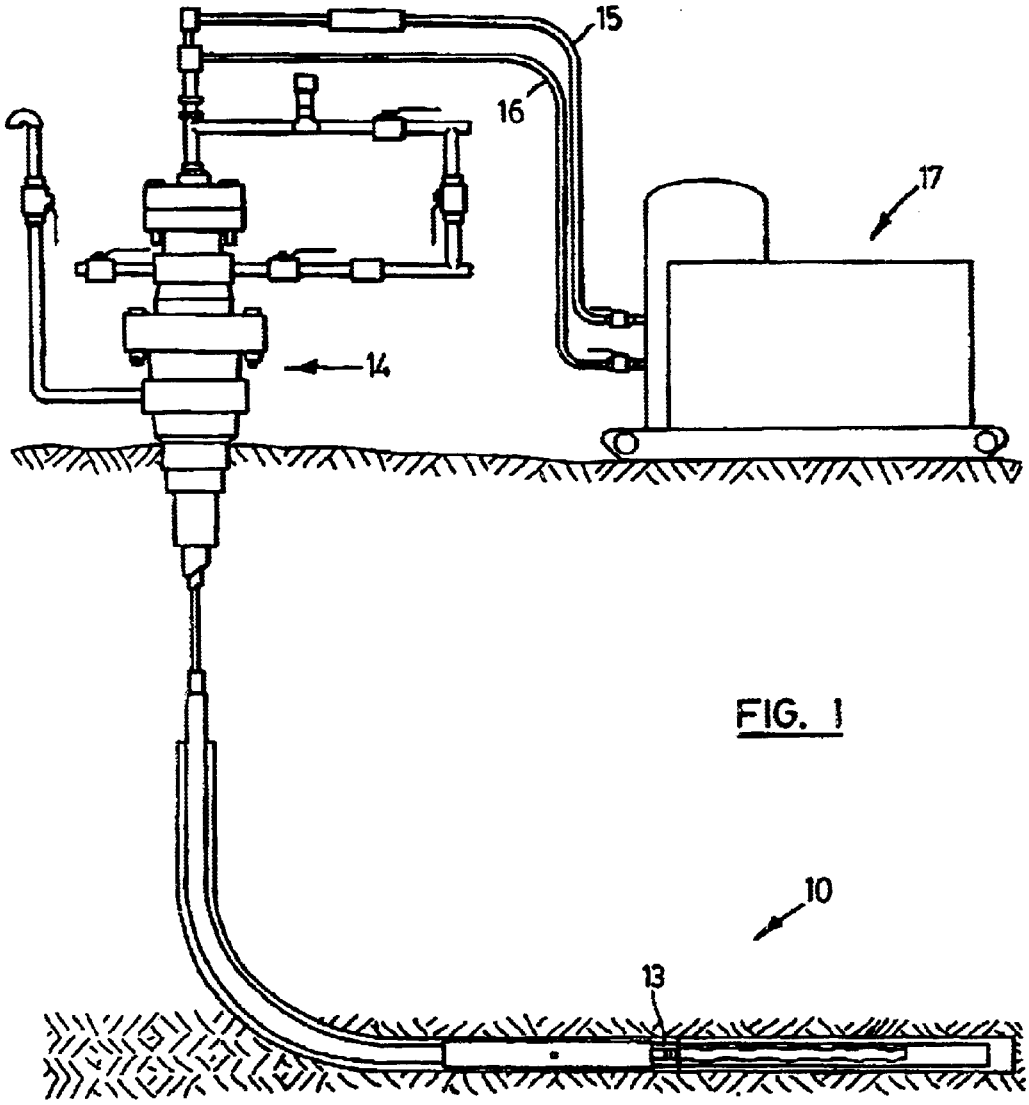
Figure 1A:
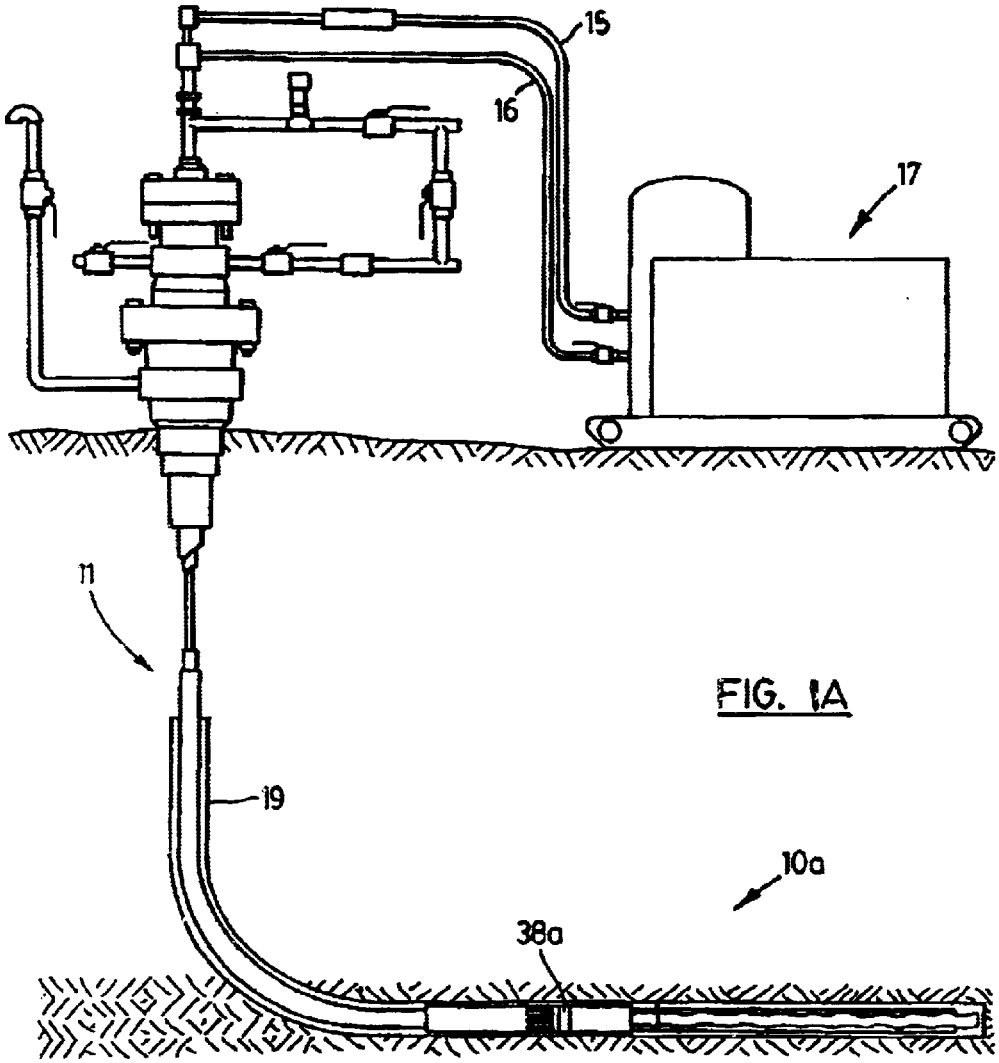

19 production casing
20 bottom hole rotary production pump
21 pump body (stator in the case of a progressive cavity pump)
22 rotor of rotary bottom hole pump
23 tag bar of rotary pump suction
30 hydraulic submersible rotary insert pump drive
31 concentric hydraulic supply subsurface coupler
32 concentric hydraulic return subsurface connection
33 subsurface hydraulic drive motor
34 submersible hydraulic drive bearing pack
34*a* drive shaft of 34
35 submersible hydraulic drive seal saver assembly
36 ported, torque compensating connector sub
36*a* ports of 36
37 rotary drive shaft
38 rotary insert pump seating assembly of through production tubing pump embodiment FIG. 1
38*a* rotary insert pump pack-off assembly of the through casing embodiment FIG. 1A

DESCRIPTION OF PREFERRED EMBODIMENTS

FIGS. 1, 2 and 3 show a hydraulic submersible insert rotary pump and drive assembly 10 according to a first embodiment of the present invention within a production tubing string 11 located inside a production casing 19 of a typical well bore. When deploying the present system, the production tubing is first run into the wellbore. The entire hydraulic submersible rotary pump and drive assembly 10 is then inserted, or lowered, into the production tubing on a steel tubing hydraulic line 16, and is seated into a sealing system 13 which is similar to that of a conventional oil well bottom hole reciprocal pump. The seating is achieved by compressing, or pushing, the drive assembly into the pump seating nipple 13 for a friction fit. The seating also centers the drive assembly in the production tubing. If unseating, or removal, of the drive assembly is required, it may be accomplished by axially pulling the assembly to dislodge it from the friction fit with the seating nipple 13.

Once seated, a second smaller hydraulic supply line 15 is run concentrically inside of the hydraulic return line 16 and is coupled to the top of the hydraulic drive motor 33 via a hydraulic coupler connection 31. The hydraulic line 16 should be of a suitably rigid material to allow some pushing on the line when inserting the assembly 10 and to rotate the assembly during coupling, yet flexible enough to follow the contour of the wellbore.

As noted earlier, prior art rotary production pumps are typically run on the end the production tubing with a drive system run separately through the production tubing after the tubing and pump body have been landed. In contrast, an important aspect of the present invention is that the entire assembly 10 may be inserted into the wellbore through the production tubing, and may likewise be removed from the wellbore by pulling the line 16 without removing the production tubing.

The various features of the rotary production pump 20 and drive assembly 30 will now be briefly described. The insertable pump drive 30 includes a hydraulic drive motor 33 with a hydraulic steel tubing deployment connection 32 on its downstream end (i.e. on the end which faces toward the top or surface end of the wellbore) connected to a concentric hydraulic tubing on/off connection or coupler 31. The coupler 31 is adapted to mate with the supply tubing 15. A sealed bearing pack 34 is connected below the drive motor 33 (i.e. to the opposite, or upstream, end of the drive motor) to seal out well bore contamination and resist pump related load forces from acting on the hydraulic drive motor. The bearing pack drive shaft 34*a* includes a spline connection to the hydraulic drive motor's drive shaft which allows torque transfer only. A seal saver assembly 35 adjacent the bearing pack 34 consists of a lubricant cavity and slidable seal assembly to act as a barrier between invading contamination and the primary seals of the bearing pack.

Another important feature of the present invention is a ported torque compensating connector sub 36 below the seal saver assembly 35 for facilitating an operable connection between the drive motor 33 and the production pump 20, for providing alignment therebetween, and for insertion/removal of the pump 20 and pump drive 30. Specifically, the connector sub 36 connects the rotary pump body 21 to the sealed bearing pack 34. It is preferably made as short as possible. The connector sub is "torque compensating" in that the connections between the pump body 21, the sub 36, the bearing pack 34 and the drive motor 33 are left-hand threaded or locking connections which counter act the right-hand torque of the drive motor 33 that is transferred through the drive shaft 37 to the pump rotor 22. This left-hand threaded or locking connection allows the hydraulic submersible insert pump assembly 20, 30 to be "torque neutral" and thus omit any other torque neutralizing tubing tools. Hence, the pump stator is kept stationary despite motor rotation.

A number of concentric ports 36*a* about the hollow connector sub 36 allow the production fluid discharged from within the rotary pump 20 to exit into a production tubing flow barrel 18, which then continues through the production tubing 11 to surface. A single port (see 36*a* in FIG. 2*a*, for example) may be sufficient in certain applications. A drive shaft 37 extends through the hollow center of the connector sub 36 and operatively connects the drive shaft 34*a* of the bearing pack 34 to the rotary pump rotor 22. A seal assembly 38 at the bottom end of the connector sub 36 seats into a pump seating nipple 13 of the production tubing string 11 to seal the rotary pump discharge end from its suction end at 23.

Surrounding the connector sub 36 and the drive motor 33 is the production tubing flow barrel 18 which is part of the production tubing string 11. The flow barrel has a greater diameter than the production tubing because the outside diameters of the hydraulic submersible rotary pump and drive assemblies 20, 30 are close to the inside diameter of the production tubing 11. Hence, the larger annular space created by the flow barrel around the drive assembly 30 provides the production fluid which exits the port(s) 36*a* with a less restrictive path past the drive assembly 30 to the production tubing. Mounted directly below the production flow barrel 18 is the pump seating nipple 13 which provides a setting location for the seal assembly 38 to seal the pump discharge from the pump suction within the production tubing 11.

FIGS. 1A, 2A and 3A show an alternate embodiment of the invention adapted for use in a wellbore without production tubing. The same reference numerals are used for the same or substantially similar components as disclosed for the first embodiment. A different pack-off system is used because there is no pump seating nipple 13 due to the lack of a tubing string. In particular, a casing or open hole pack-off 38*a* is incorporated which is set and unset at a desired point in a production casing 19 or in an open borehole to seal the pump discharge from the pump suction. This alternate embodiment of the assembly 10*a* is deployed into a well bore in the same manner as the assembly 10 in FIGS. 1–3, and allows oil field operators to use a hydraulic submersible rotary pump drive assembly 30 in small diameter casings or where tubing is not necessary. As well, this assembly may be used for both production or down hole injection purposes.

In use, the pump and drive assembly 20, 30 is run to the desired setting depth with the steel hydraulic return tubing 16, where the pack-off assembly 38*a* is set against the casing 19 or formation wall to seal the pump suction 23 from the pump discharge 36*a*. The second steel tubing hydraulic supply 15 is then run concentrically inside of the return string 16, and is coupled to the supply hydraulic coupler 31 above the drive motor 33. The hydraulic supply and return lines 15, 16 are then connected to the surface hydraulic supply unit 17 at the wellhead with appropriate fittings.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below.

I claim:

1. A fluid pumping assembly for deployment in a well bore comprising:

a production pump;

a submersible hydraulic motor for driving said pump;

a connector sub having a tubular body with a longitudinal cavity extending therethrough, said body having a first end connectable to said pump for fluid communication therewith, a second end connectable to said motor, and at least one port accessing said cavity for discharging said fluid; and, a seal assembly at said first end of said body to provide a seal between the discharge and suction of said pump.

2. The assembly of claim 1 wherein said connector sub includes torque compensating means comprising connections at each of said first and second ends of said body threaded in a circumferential direction counter to the torque of said motor.

3. The assembly of claim 2 wherein said connector sub includes an elongate drive shaft adapted to extend longitudinally through said cavity and to operatively connect said motor to said pump for transferring torque therebetween.

4. The assembly of claim 2 further comprising:

a production tubing string through which said pump, motor and connector sub are adapted to pass; and, a generally tubular flow barrel having an inside diameter greater than said tubing string for mounting to a distal end of said tubing string and for radially surrounding said motor and connector sub to facilitate the passage of said fluid from said at least one port past said connector sub and motor to said tubing string.

5. The assembly of claim 1 wherein said connector sub includes an elongate drive shaft adapted to extend longitudinally through said cavity and to operatively connect said motor to said pump for transferring torque therebetween.

6. The assembly of claim 5 further comprising:

a production tubing string through which said pump, motor and connector sub are adapted to pass; and, a generally tubular flow barrel having an inside diameter greater than said tubing siring for mounting to a distal end of said tubing string and for radially surrounding said motor and connector sub to facilitate the passage of said fluid from said at least one port past said connector sub and motor to said tubing string.

7. The assembly of claim 1 further comprising:

a production tubing string through which said pump, motor and connector sub are adapted to pass; and, a generally tubular flow barrel having an inside diameter greater than said tubing string for mounting to a distal end of said tubing string and for radially surrounding said motor and connector sub to facilitate the passage of said fluid from said at least one port past said connector sub and motor to said tubing string.

8. A fluid pumping assembly for deployment in a well bore comprising:

a production pump;

a submersible hydraulic motor for driving said pump;

a connector sub having a tubular body with a longitudinal cavity extending therethrough, said body having a first end connectable to said pump for fluid communication therewith, a second end connectable to said motor, and at least one port accessing said cavity for discharging said fluid;

a production tubing string through which said pump, motor and connector sub are adapted to pass; and, a generally tubular flow barrel having an inside diameter greater than said tubing string for mounting to a distal end of said tubing string and for radially surrounding said motor and connector sub to facilitate the passage of said fluid from said at least one port past said connector sub and motor to said tubing string.

9. The assembly of claim 8 wherein said connector sub includes torque compensating means comprising connections at each of said first and second ends of said body threaded in a circumferential direction counter to the torque of said motor.

10. The assembly of claim 8 wherein said connector sub includes an elongate drive shaft adapted to extend longitudinally through said cavity and to operatively connect said motor to said pump for transferring torque therebetween.

11. The assembly of claim 8 wherein said connector sub includes an elongate drive shaft adapted to extend longitudinally through said cavity and to operatively connect said motor to said pump for transferring torque therebetween.

* * * * *

UNITED STATES PATENT AND TRADEMARK OFFICE

CERTIFICATE OF CORRECTION

PATENT NO. : 6,623,252 B2 
DATED : September 23, 2003
INVENTOR(S) : Edmund C. Cunningham It is certified that error appears in the above-identified patent and that said Letters Patent is hereby corrected as shown below:

Title page,
Item [65], before Prior Publication Data, insert the following:
-- [30] Foreign Application Priority Data
Oct. 25, 2000 (CA) Canada …. 2,324,319 --.

Signed and Sealed this

Sixteenth Day of December, 2003

JAMES E. ROGAN
*Director of the United States Patent and Trademark Office*